US008739672B1

(12) United States Patent
Kelly

(10) Patent No.: US 8,739,672 B1
(45) Date of Patent: Jun. 3, 2014

(54) FIELD OF VIEW SYSTEM AND METHOD

(75) Inventor: John T. Kelly, Murrieta, CA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 34 days.

(21) Appl. No.: 13/473,381

(22) Filed: May 16, 2012

(51) Int. Cl.
*F41G 3/00* (2006.01)
*F41A 17/08* (2006.01)

(52) U.S. Cl.
USPC ..... 89/1.11

(58) Field of Classification Search
CPC ..... F41A 17/08; F41G 3/00
USPC ..... 89/1.11; 235/400, 404
See application file for complete search history.

(56) References Cited

U.S. PATENT DOCUMENTS

| | | | | |
|---|---|---|---|---|
| 5,686,690 | A * | 11/1997 | Lougheed et al. | 89/41.17 |
| 6,119,976 | A * | 9/2000 | Rogers | 244/13 |
| 6,963,800 | B1 * | 11/2005 | Milbert | 701/533 |
| 6,977,593 | B2 * | 12/2005 | Schmedemann et al. | 340/686.1 |
| 8,325,178 | B1 * | 12/2012 | Doyle, Jr. | 345/419 |
| 8,336,777 | B1 * | 12/2012 | Pantuso et al. | 235/409 |
| 8,544,375 | B2 * | 10/2013 | Kravitz | 89/1.11 |
| 2005/0268521 | A1 * | 12/2005 | Cox et al. | 42/130 |
| 2006/0249010 | A1 * | 11/2006 | John et al. | 89/1.11 |
| 2010/0031808 | A1 * | 2/2010 | Whitlow et al. | 89/1.11 |
| 2010/0269674 | A1 * | 10/2010 | Brown et al. | 89/1.11 |
| 2012/0000349 | A1 * | 1/2012 | Couronneau et al. | 89/1.11 |
| 2012/0000979 | A1 * | 1/2012 | Horvath et al. | 235/407 |
| 2012/0097741 | A1 * | 4/2012 | Karcher | 235/404 |
| 2012/0126002 | A1 * | 5/2012 | Rudich | 235/404 |
| 2013/0118341 | A1 * | 5/2013 | Brylev | 89/1.11 |
| 2013/0130205 | A1 * | 5/2013 | Matthews et al. | 434/22 |

OTHER PUBLICATIONS

Army Study Guide, Defend-Range Card Preparation, www.armystudyguide.com/content/Leadersbook_information/...defend-range-card-prepara-2.shtml, accessed on May 15, 2012, 8 pages.
Ngo et al., Blast Loading and Blast Effects on Structures—An Overview, 16 pages.
Paul, GPS Retransmission Inside Military Ground Vehicles White Paper, Apr. 2010, 11 pages.
Pietrek, An In-Depth Look at the Win32 Executable File Format, Part 2, msdn.microsoft.com/en-us-magazine/cc301808.aspx, accessed on Mar. 15, 2012, 7 pages.
Thryn, How to Make a Range Card, www.ehow.com/how_6765856_make-range-card.html, accessed on May 15, 2012, 3 pages.
Wikipedia, Active Protection System, en.wikipedia.org/wiki/Active-protection_system, accessed on May 15, 2012, 5 pages.
Wikipedia, Laser Rangefinder, en.wikipedia.org/wiki/Laser_rangefinder, accessed on May 15, 2012, 5 pages.
Wikipedia, Multiple Integrated Laser Engagement System, en.wikipedia.org/wiki/Multiple_Integrated_Laser_Engagement_System, accessed on May 15, 2012, 4 pages.

* cited by examiner

*Primary Examiner* — Bret Hayes
(74) *Attorney, Agent, or Firm* — Donna P. Suchy; Daniel M. Barbieri

(57) ABSTRACT

Systems and methods for coordinating fields of view are provided. Sensor data may be generated regarding movement in one or more planes and used as boundaries for the field of view. A geographic location may also be associated with the field of view. Fields of view from two or more geographic locations may be aggregated to determine a collective field of view. The collective field of view may be provided to an electronic display. In some cases, the field of view may be a field of fire associated with a ballistic weapon.

20 Claims, 9 Drawing Sheets

200

Range Card

202 SQD 333
PLT 3rd
CO B

Magnetic North 204

206

208 Position: Primary Date: 9/Oct/05/0735 210

212 Weapon: M2 SO CAL Each Circle Equals: 200m 214

| No. | Direction Deflection | Elevation | Range | Ammo | Description |
|---|---|---|---|---|---|
| 1 | L 385 | +5m | 1580 | | Windmill |
| 2 | R 380 | +10m | 1420 | | Orchard |
| 3 | L 370 | -10m | 740 | | Bridge |
| 4 | L 285 | +5m | 1000 | | RJ 50 |
| 5 | R 110 | -3m | 600 | | Bridge |
| 6 | R 080 | +2m | 1100 | | RJ 478 |

216 218 220 222 224 226

FIELD OF VIEW SYSTEM AND METHOD

BACKGROUND

The present specification relates generally to determining a field of view. More particularly, the present specification relates to a system and method that allow an individual's field of view to be determined and coordinated with other individuals.

Conventionally, individuals may be assigned to different locations in an area, to increase the collective field of view of the individuals. For example, soldiers may be positioned in various locations in an area, to monitor the area for activity. An individual soldier's field of view may be limited due to obstructions, varying terrain elevations, and other characteristics of the area. To increase the collective field of view of the soldiers, the soldiers may be positioned in the area such that one soldier's obstructed field of view may be covered by another soldier's unobstructed field of view.

In some cases, an individual's field of view may be, or may include, a field of fire. If an individual in the area is an armed soldier, for example, the area that can be covered by the soldier with a firearm or other form of weaponry may be referred to as a field of fire. For example, a sniper may be positioned at the end of a field. The sniper's field of fire may include the entirety of the field or out to a certain range, based on the capabilities of the sniper's weapon. Similar to coordinating a collective field of view, a team of armed soldiers may be positioned and oriented throughout an area to provide a collective field of fire that optimizes the team's coverage of the area.

The positioning and orienting of soldiers to provide an optimal field of fire is often left to the individual soldiers and to their commander. In dynamic situations, such as when the soldiers are moving across an area, the field of fire for an individual soldier is often left to the expertise of the soldier. For example, each soldier may determine the best directions in which to aim his weapon, while moving. In relatively static situations, such as with the deployment of snipers, individual soldiers may report their positions, fields of view, and fields of fire to a commander. The commander may review the reported information to determine whether the soldiers' fields of fire are correctly overlapping and interlocking, whether there exist openings in their collective field of fire, whether the proper types of weapons are deployed in the correct positions, etc. The commander may then relay any changes to a soldier's position or orientation to the individual soldier. However, this process is time-consuming and subject to errors when a soldier estimates his position, field of view, field of fire, and other information reviewed by the commander. Moreover, this process may not even be used when soldiers are moving, under fire, or other such times that make the estimation and reporting process infeasible. Applicant has discovered that there may be a need for a system or method that allows an individual's field of view and/or field of fire to be quickly and automatically determined.

SUMMARY

One embodiment relates to a method of determining a field of view. The method includes receiving sensor data regarding the field of view, the sensor data comprising measurements indicative of one or more boundaries for the field of view. The method also includes determining a geographic location at which the sensor data was generated. The method further includes analyzing the sensor data and the geographic location to determine the field of view. The method additionally includes providing the field of view to an electronic display.

Another embodiment relates to a system for determining a field of view. The system includes processing electronics configured to receive sensor data regarding the field of view. The sensor data includes measurements indicative of one or more boundaries for the field of view. The processing electronics are further configured to determine a geographic location at which the sensor data was generated and to analyze the sensor data and the geographic location to determine the field of view. The processing electronics are further configured to provide the field of view to an electronic display.

A further embodiment relates to a system for determining a field of fire. The system includes a motion sensor configured for attachment to a weapon, the motion sensor detecting a movement of the weapon. The system also includes an azimuth sensor configured for attachment to the weapon, the azimuth sensor generating azimuth measurements within a first plane of movement for the weapon. The system further includes a location sensor configured to determine a geographic location of the weapon and a user interface device. The system yet further includes processing electronics in communication with the user interface device, motion sensor, azimuth sensor, and location sensor. The processing electronics are configured to use the azimuth measurements and the geographic location to determine the field of fire for the weapon.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION

Referring generally to the Figures, systems and methods for determining a field of view are disclosed. In some embodiments, individuals deployed to an area may be equipped with electronics configured to rapidly record data regarding the individuals' fields of view. The data may be analyzed locally or transmitted to a coordinator to assess the individuals' fields of view. An adjustment to an individual's position and/or orientation may be determined by the coordinator to optimize the collective field of view of the individuals.

In some cases, an individual deployed to an area may be equipped with a weapon, such as a firearm, mortar, or other projectile weapon. The individual's field of view may include a field of fire, representing the area that may be covered by the individual's weapon. Such a field of fire may be the entirety of the individual's field of view or may be a subset of the field of view. According to some embodiments, the individual's electronics may be configured to record data regarding the individual's field of fire. For example, the individual's weapon may be equipped with sensors and other electronics configured to record horizontal and/or vertical sweeps made with the weapon by the individual. The recorded data may be transmitted to a device operated by another individual, to facilitate coordination of the individuals' fields of fire. For example, data may be relayed to a device operated by a commander, so that the commander may review the individuals' fields of fire. In another example, data may be shared between the deployed individuals to alert an individual to a hazardous condition (e.g., an individual is located within another individual's field of fire).

While the disclosed systems and methods are described primarily with regard to the deployment of armed soldiers throughout an area, the systems and methods may also be configured for use in other situations. For example, a deployed individual may be a civilian (e.g., a police officer, a firefighter, etc.), a drone, or a vehicle. The field of fire determinations made regarding a weapon may also be adapted for use with an intelligence, surveillance, and reconnaissance (ISR) device, a camera, a water nozzle, a less-than-lethal device, or any other form of aimed device.

Figure 1:
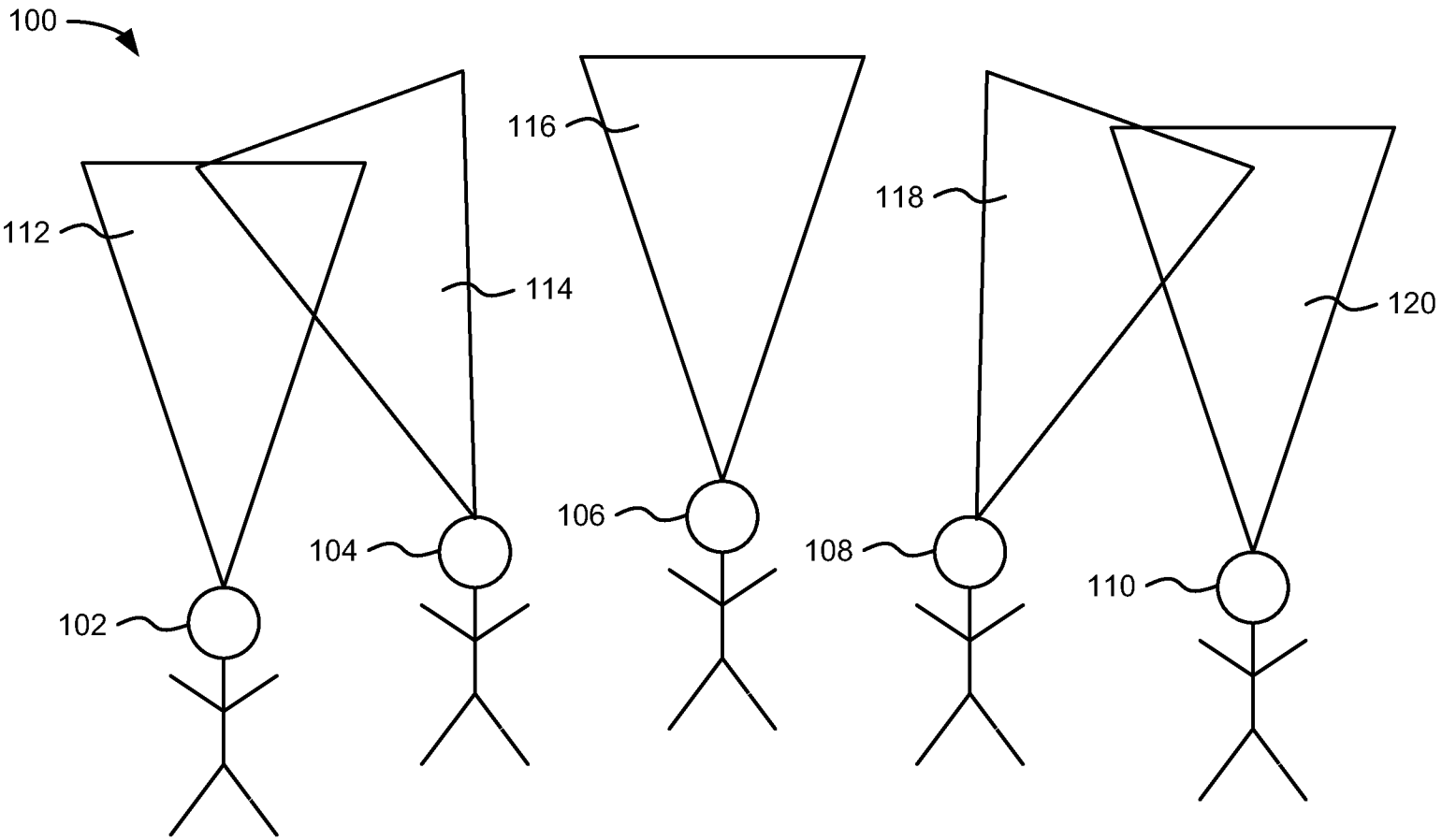
FIG. 1 is an illustration of individuals deployed to an area.

Referring now to FIG. 1, an illustration 100 of individuals deployed to an area is shown, according to exemplary embodiments. Some or all of individuals 102-110 may be deployed to static positions. For example, individuals 102-110 may be snipers positioned throughout the area. In other cases, some or all of individuals 102-110 may be moving. For example, individuals 102-110 may be rescue workers searching the area for a missing person.

Each of individuals 102-110 may have a field of view of the area. For example, individuals 102-110 may have fields of view 112-120, respectively. Fields of view 112-120 may include components along any number of planes of view. For example, a field of view may include a horizontal component that corresponds to a horizontal view from the perspective of an individual (e.g., when the individual is looking straight ahead or when the individual looks to the left or right). In another example, a field of view may include a vertical component corresponding to the vertical view from the perspective of an individual (e.g., when the individual is looking straight ahead or when the individual looks up or down). Fields of view 112-120 may also have varying ranges, depending on the location of an individual and the layout of the terrain (e.g., due to a change in the elevation of the terrain, due to an obstruction, etc.).

In some embodiments, fields of view 112-120 may be, or may include, fields of fire. If individuals 102-110 are equipped with devices that can be aimed (e.g., weapons, cameras, firefighting equipment, etc.), the portions of the area that may be covered using such equipment may be fields of fire. For example, individual 102 may be equipped with a firearm that may reach targets located within field of view 112 (i.e., field of view 112 is also a field of fire). In such a case, field of view 112 may correspond to individual 102 sweeping the weapon from a first position to a second position, creating a field of fire.

Fields of view 112-120 may overlap depending on the location and orientation of individuals 102-110. For example, field of view 112 may overlap field of view 114 based on the locations and orientations of individuals 102-104. A collective field of view may be the aggregate of fields of view 112-120. However, the collective field of view may have gaps, if fields of view 112-120 do not properly overlap. For example, individuals 104-106 may be positioned and oriented such that their respective fields of view 114-116 do not overlap. In various embodiments, data regarding fields of view 112-120 may be recorded and evaluated, to optimize the collective field of view for individuals 102-110.

Figure 2:
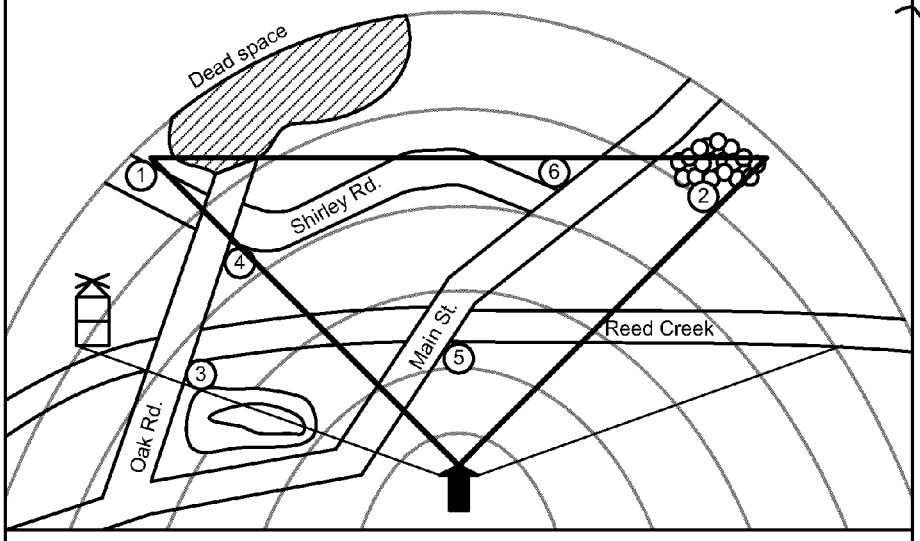
FIG. 2 is an illustration of a range card.

Referring now to FIG. 2, an illustration of a range card 200 is shown, according to some embodiments. An individual deployed to an area, such as a sniper, may complete range card 200 manually and return range card 200 to a commander for review. The commander may analyze range card 200 and range cards completed by other deployed individuals, to determine a position and orientation for the individuals that optimizes their collective coverage of the area. According to various embodiments, range card 200 may be an electronic range card presented on an electronic display. In such cases, some or all of range card 200 may be populated automatically using sensor measurements taken regarding the location and/or orientation of the deployed individual.

As shown, range card 200 may include a number of boxes that may be completed by an individual deployed to the area and/or automatically populated based on various data recorded with respect to the individual (e.g., the identity of the individual, sensor measurements taken regarding the individual's location and orientation, etc.). Range card 200 may include a box 202 in which the individual's squadron, platoon, and company may be identified. For example, the individual may use box 202 to identify himself as belonging to the 333$^{rd}$ squadron of the 3$^{rd}$ platoon in company B. Range card 200 may also include a box 210 to identify when range card 200 was completed and a box 208 to identify the individual's position when range card 200 at the time. Range card 200 may further include a box 212 to identify the individual's weapon. For example, the individual may use box 212 to specify that the individual's weapon is a fifty-caliber machine gun, allowing the commander to evaluate the offensive capabilities from the individual's position.

Range card 200 may include any number of boxes to indicate terrain estimations in front of the individual. In some embodiments, range card 200 may include a box 204 to identify the direction of magnetic north. For example, the individual filling out range card 200 may utilize a compass to manually determine the direction of magnetic north, which may serve as a reference for estimated azimuths regarding the terrain. In cases in which sensor data is used to populate range card 200, measurements from a compass sensor may indicate the direction of magnetic north. In some cases, range card 200 may include box 206 in which the terrain in front of the individual may be drawn. For example, assume that the area in front of the individual includes a number of landmarks, such as roads, a windmill, an orchard, and a bridge. The individual may sketch the layout of the terrain and locations of the landmarks in box 206, to provide a commander with a sense of the individual's field of view. In another example, map data associated with the individual's location may be used to draw the terrain in box 206 and identify landmarks. Box 206 may include a number of circles, with each circle being separated by a distance specified in box 214 of range card 200. For example, each circle in box 206 may represent an additional two-hundred meters from the individual's position.

Range card 200 may include any number of boxes to indicate estimated locations of landmarks sketched in box 206.

For example, boxes 216 may include references to the six landmarks drawn and labeled in box 206 of range card 200 (i.e., landmarks 1-6). A description of the respective landmarks may be entered into boxes 226 of range card 200. For example, the first landmark may be described as a windmill, the second landmark may be described as an orchard, etc. Range card 200 may also include boxes for estimated measurements regarding the locations of the landmarks relative to the individual associated with range card 200. For example, the azimuths, elevations, and ranges to the landmarks may be entered into boxes 218, 220, 222, respectively. In some cases, the individual may also complete boxes 224, if different types of ammunition are to be used to cover the different landmarks.

Range card 200 may also use box 206 to sketch his estimated field of fire. As shown, assume that the individual, when located at the position shown, is able to sweep his weapon from aiming at the first landmark to the second landmark or vice versa. The field of fire may include some or all of the field of view sketched in box 206. The range of the field of fire may be constant or may vary based on the terrain in front of the individual. In some cases, dead space may be indicated in box 206, to denote areas that cannot be observed or covered within a field of fire. In various embodiments, dead space may be manually identified by the individual (e.g., by operating an interface device), based on a threshold change in terrain elevation between the individual and the dead space, or based on an obstacle being present in the individual's field of view.

Range card 200 may be returned to a commander for review. The commander may analyze the indicated terrains and fields of fire in range card 200 and other range cards, to determine an optimal position and/or orientation for the reporting individuals. For example, the commander may order the individual that completed range card 200 to relocate to the bridge depicted in box 206 and face magnetic north. However, this method may be impractical if range cards are completed manually by the deployed individuals. For example, it may be impractical for individuals on the move to complete range cards periodically. It may also be impractical for an individual to complete a range card, if a deployed individual is under fire or under the threat of enemy fire.

Figure 3:
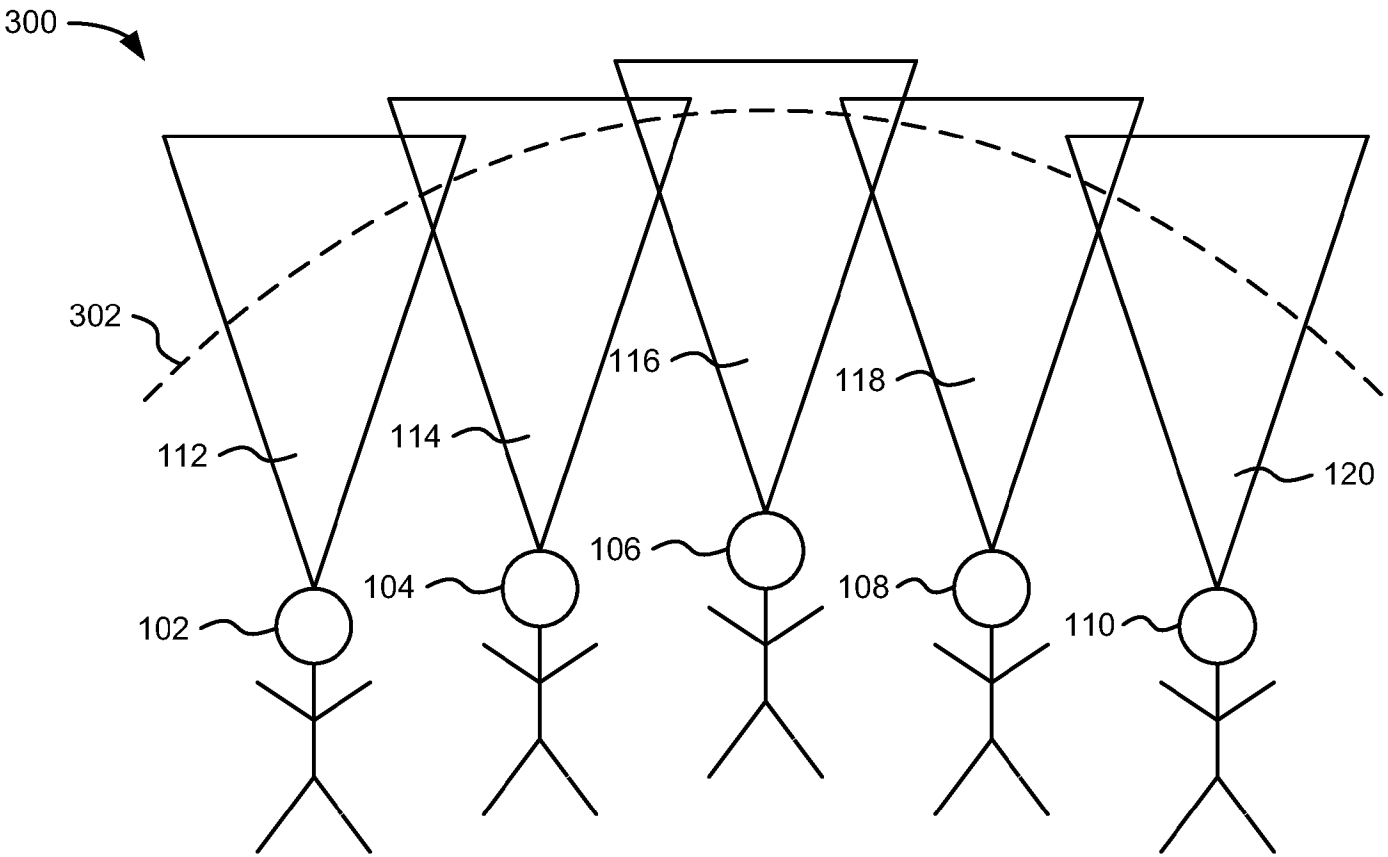
FIG. 3 is an illustration of the individuals of FIG. 1 having adjusted orientations.

Referring now to FIG. 3, an illustration 300 of the individuals of FIG. 1 having adjusted orientations is shown, according to exemplary embodiments. As shown, the positions and orientations of individuals 102-110 may be adjusted, to optimize their collective field of view 302. For example, the position and orientation of individual 104 may be adjusted such that his field of view 114 overlaps field of view 112 of individual 102 and field of view 116 of individual 106. Similarly, the position and orientation of individual 108 may be adjusted such that his field of view 118 overlaps field of view 116 of individual 106 and field of view 118 of individual 108. Thus, the collective field of view 302 of individuals 102-120 may be optimized to provide a more cohesive field of view of the area.

In some cases, optimization of collective field of view 302 may involve reducing or eliminating gaps between the fields of view 112-120. However, collective field of view 302 may be optimized to achieve any number of goals. In certain situations, for example, a gap in collective field of view 302 may even be desirable. For example, gaps between fields of view 112-120 may be acceptable to provide greater emphasis to a portion of the area. In one example, assume that greater emphasis is to be provided to the portion of the area in front of individual 110. In such a case, a gap between field of view 116 and field of view 118 may be acceptable and individual 108 may be oriented and positioned to increase the overlap of field of view 118 and field of view 120 (e.g., to provide redundancy in this portion of the area).

Collective field of view 302 may be determined by a coordinator (e.g., an individual in command). For example, individuals 102-110 may return range cards, similar to range card 200 shown in FIG. 2, to the coordinator. The coordinator may review the range cards to determine positions and orientations for individuals 102-110 that optimize collective field of view 302. According to various embodiments, some or all of individuals 102-110 may be equipped with electronics configured to record data regarding fields of view 112-120 and to report the data to a device operated by the commander. The commander's device may be configured to display data regarding fields of view 112-120 (e.g., as part of electronic range cards, as part of a three-dimensional representation of the area, etc.) and/or aggregate data regarding fields of view 112-120 to display collective field of view 302. In some embodiments, the commander's device may be configured to automatically (i.e., without further user input) analyze the reported data and suggest adjusted locations and/or positions for individuals 102-110 to the coordinator and/or directly to individuals 102-110.

Figure 4:
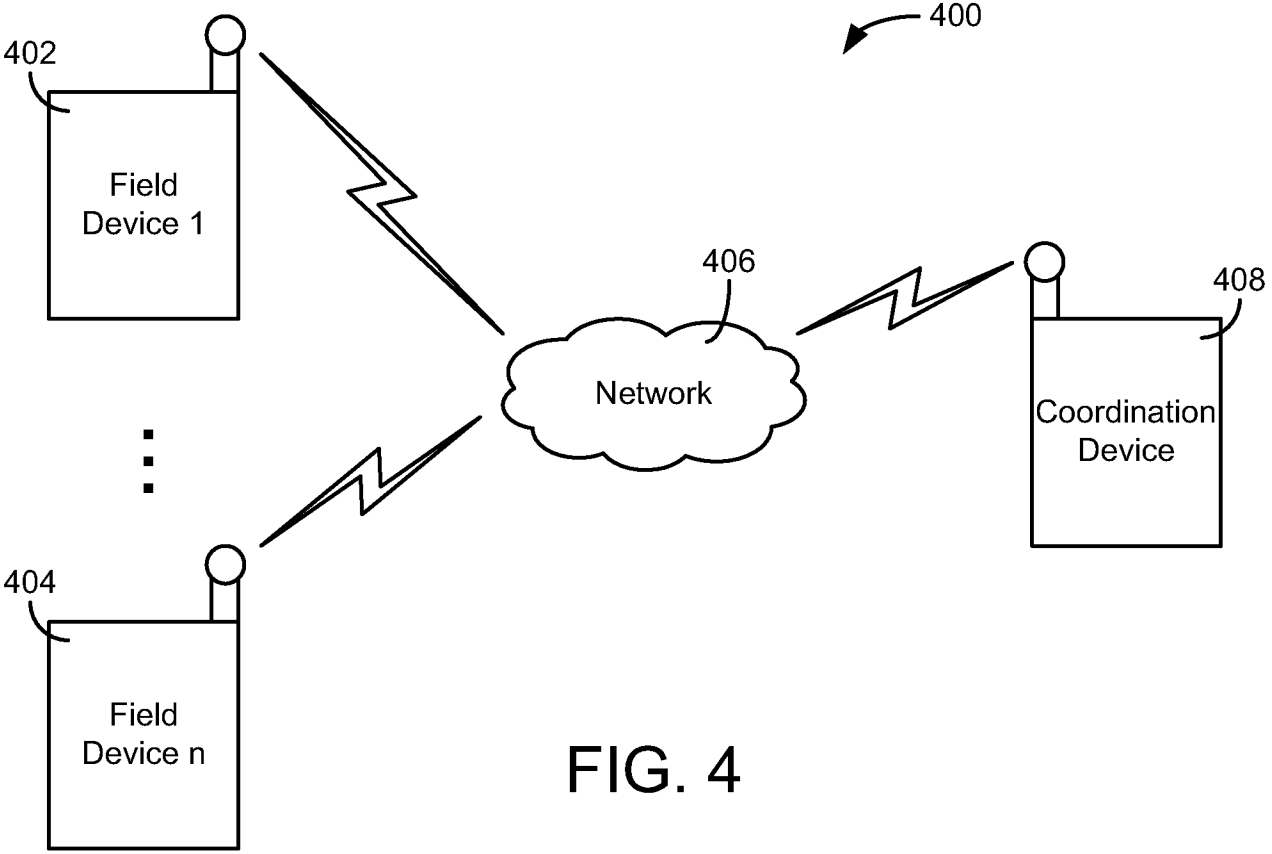
FIG. 4 is a communications system to coordinate the deployment of individuals in an area, according to an exemplary embodiment.

Referring now to FIG. 4, a communications system 400 to coordinate the deployment of individuals in an area is shown, according to an exemplary embodiment. Communications system 400 may be used, for example, to capture data regarding the fields of view of the deployed individuals and to relay the information to the other individuals and/or a coordinator. The data may be captured and relayed in real-time, periodically, or in response to a manual request, in various embodiments.

Communications system 400 may include any number of field devices 402-404 (i.e., a first field device through nth field device). Individuals deployed throughout the area may be equipped with field devices 402-404. Field devices 402-404 may be configured to capture field of view data regarding their respective user's field of view. In some embodiments, field devices 402-404 may be handheld devices. For example, an individual operating field device 402 may point field device 402 in a selected direction, to capture field of view data. In other embodiments, field devices 402-404 may be integrated into other equipment worn or carried by the deployed individuals. For example, some or all of field device 402 may be integrated into a weapon or other aimed device carried by a deployed individual. In such cases, the field of view data generated by field device 402-404 may include, or may be, field of fire data.

Boundaries for a field of view or field of fire may be recorded by field devices 402-404 in any number of ways. In one embodiment, field devices 402-404 may include user interface devices (e.g., keypads, microphones, touch screen displays, etc.) to allow the deployed individuals to specify the boundaries manually. For example, a deployed individual may use a compass to determine the location of magnetic north and manually enter azimuth data into field device 402 to define the horizontal boundaries for the individual's field of fire. In some embodiments, azimuth, tilt, location, and/or motion sensors may be incorporated into field devices 402-404 to facilitate the defining of the boundaries. In one embodiment, sensors of field device 402 may be attached to a weapon carried by the deployed individual. The individual may then point the weapon in a direction that corresponds to a boundary for a field of view or field of fire. In such a case, azimuth and/or tilt sensor measurements may be recorded by field device 402, to define a boundary. In some embodiments, the measurements may be recording in response to the individual activating an interface device (e.g., the individual presses a button while aiming in a particular direction). In other embodiments, motion sensors may detect a movement of the weapon and the maximum azimuth or tilt measurements may be used as the boundaries. For example, the individual may sweep the weapon along a horizontal or vertical plane between the boundaries of the individual's field of fire. In such a case, the maximum angles recorded during such movement may be used as the boundaries.

In some embodiments, communications system 400 may also include a coordination device 408. Coordination device 408 may receive field of view data from field devices 402-404 via a network 406. Coordination device 408 may aggregate the field of view data to generate a collective field of view. In some cases, coordination device 408 may provide the collective field of view to a user interface device, such as an electronic display. For example, a coordinator operating coordination device 408 may review the individual fields of view and/or the collective field of view on the display. In one embodiment, coordination device 408 may be configured to analyze received field of view data to determine adjusted locations and/or positions for the individuals throughout the field. The adjusted locations and/or positions determined by coordination device 408 may be provided to the display (e.g., for review by the coordinator) or may be communicated to field devices 402-404.

Some or all of the functionality of coordination device 408 may be integrated into field devices 402-404 or vice versa. In one embodiment, coordination device 408 may itself be a field device configured to record field of view data. For example, the coordinator may also have a field of view and/or a field of fire that may be combined with those of other deployed individuals. In further embodiments, one of field devices 402-404 may be designated the primary coordination device and one or more of field devices 402-404 may be identified as being backup coordination devices (e.g., a secondary, tertiary, etc., coordination device). For example, if the primary coordination device is unresponsive (e.g., after a timeout), coordination responsibility may be shifted to the secondary coordination device.

In some embodiments, field devices 402-404 may be configured to generate alerts, if a hazardous condition is detected. For example, an alert may be generated if one of field devices 402-404 is located within a field of fire indicated by another one of field devices 402-404. In one embodiment, coordination device 408 may analyze field of fire data to determine whether one of field devices 402-404 is located within another field of fire. If such a condition exists, coordination device 408 may provide an indication to the field device located in the field of fire and/or the field device associated with the field of fire. The indication may cause the receiving field device to provide an alert to the operator of the device (e.g., by causing a speaker to sound an alarm, by causing a display to show a warning, etc.).

Network 406 may include any number of wireless or wired connections. For example, field devices 402-404 and coordination device 408 may communicate wirelessly via radio connections, cellular connections, satellite connections, or other forms of wireless connections. Network 406 may also include any number of intermediary devices (e.g., servers, routers, data lines, etc.). In one embodiment, communication via network 406 may be encrypted and/or limited to field devices 402-404 and coordination device 408. For example, the devices in system 400 may be assigned unique identifiers and configured to accept only incoming data from devices in the set of unique identifiers.

Figure 5A:
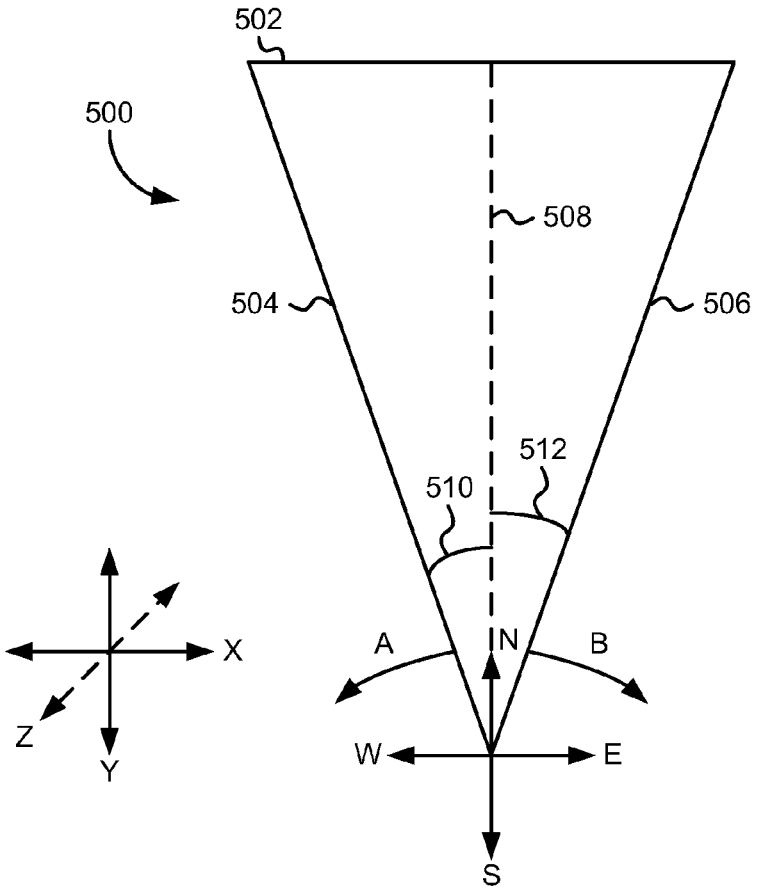
FIGS. 5A-5B are illustrations of measurements that may be recorded for a deployed individual, according to exemplary embodiments.

Referring now to FIG. 5A, an illustration 500 is shown of a field of view 502. Various measurements may be taken regarding field of view 502 by a field device, such as field devices 402-404 shown in FIG. 4. In some embodiments, field of view 502 may be a two-dimensional component of an individual's field of view and/or field of fire. As shown, field of view 502 is represented as a plane in a three-dimensional space. For example, field of view 502 may correspond to the horizontal component of an individual's view of the terrain. Field of view 502 may be perfectly horizontal with respect to the terrain or may be positioned at an angle. In some embodiments, a position sensor may determine the location at which the measurements regarding field of view 502 are captured.

In some embodiments, measurements regarding field of view 502 may be recorded between a first orientation and a second orientation. For example, the first and second orientations may correspond to an individual facing different directions. Similarly, the first and second orientations may correspond to a weapon or other piece of equipment being aimed in different directions, if field of view 502 is also a field of fire. In some embodiments, the first and second orientations may be manually specified by the individual. For example, the individual may press one or more buttons of a field device. If field of view 502 is a field of fire, for example, the individual may aim a weapon in a first direction, press a button to signify a first boundary for the field of fire, sweep the weapon to a second bound for the field of fire, and press the button again to signify the second boundary. In other embodiments, one or more motion sensors (e.g., an accelerometer, a gyro sensor, etc.) may be used to automatically detect the boundaries. For example, the boundaries may also be determined by identifying the widest swing in azimuth when a weapon is swept between directions 504, 506. Thus, an armed individual may rapidly update his field of fire through the performance of a simple motion. In certain cases, such as when deployed individuals are moving, this may allow a coordinator to quickly assess the fields of fire for the moving individuals.

Orientations may be measured by a field device relative to a known direction 508, such as magnetic north. In some embodiments, direction 508 may be determined by a magnetic compass sensor integrated as part of the field device. For example, the compass sensor may be part of an azimuth sensor configured to measure azimuth 510 and azimuth 512 relative to direction 508. For example, azimuth 510 may be measured when an individual faces or aims along direction 504. Similarly, azimuth 512 may be measured when the individual faces or aims along direction 506. In some embodiments, a tilt sensor may also be used to perform an estimate of elevation, which can be used to compensate for cases in which field of view 502 is not strictly horizontal to the ground.

One or more range measurements may also be taken regarding field of view 502. In one embodiment, range measurements may be taken when azimuths 510, 512 are measured. For example, a rangefinder may be used to determine the ranges along directions 504, 506. In further embodiments, range measurements may also be measured at intermediary orientations within field of view 502. For example, range measurements may be taken within field of view 502 to identify obstructions within field of view 502. If field of view 502 is a field of fire, equipment data may be used to determine the ranges. For example, a weapons database may include data regarding the particular type of weapon used by the individual, such as the range that can be reached by that type of weapon. In yet further embodiments, ranges and/or landmarks within field of view 502 may be indicated manually by the deployed individual via input to a user interface device.

Figure 5B:
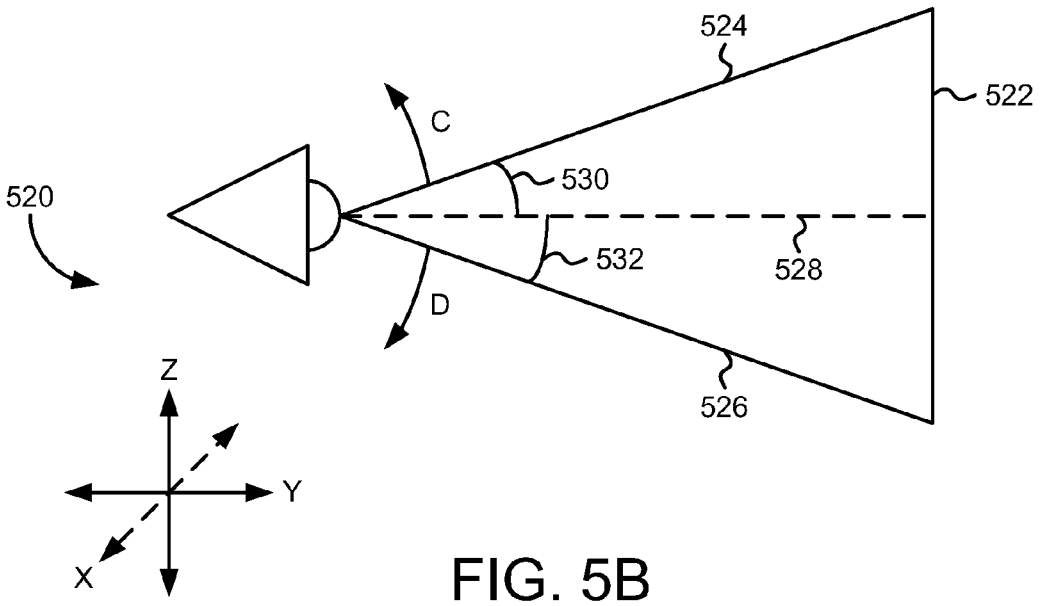

Referring now to FIG. 5B, an illustration 520 is shown of a field of view 522, according to an exemplary embodiment. As shown, field of view 522 may be another two-dimensional component of an individual's field of view. Field of view 522 may be along a direction relative to field of view 502 in FIG. 5A, such as a direction that is perpendicular to field of view 502. In other words, fields of view 502, 522 may be components of an individual's three-dimensional field of view corresponding to two different planes of view. For example, field of view 502 may be a horizontal component of an individual's three-dimensional field of view and field of view 522 may be a vertical component of the three-dimensional field of view. In other words, field of view 522 may exist for an individual when located in the same position that results in field of view 502.

Measurements regarding field of view 522 may include similar types of measurements as those taken for field of view 502. In one embodiment, angle measurements may be taken relative to a direction 528. For example, a tilt sensor may use the horizontal direction as the reference direction 528. The tilt sensor may measure angle 530 between a first direction 524 and the reference direction 528. For example, the tilt sensor may measure the angle between an upper bound and the horizontal direction, when a weapon is swept up and down. The tilt sensor may also measure angle 532 between a second direction 526 and reference direction 528 (i.e., direction 526 is another bound for field of view 522). Also similar to field of view 502, ranges may be associated with field of view 522. For example, range data may be associated with field of view 522 via a rangefinder, manual inputs from the individual, and/or equipment data.

In some embodiments, measurements regarding field of view 522 may be combined with measurements regarding field of view 502, to provide a three-dimensional field of view for a deployed individual. Thus, three-dimensional data may be used by a coordination device to optimize the collective field of view of individuals deployed to an area. For example, assume that one individual is positioned at the base of a plateau and another individual is located at the top of the plateau. The vertical field of view of the individual at the base of the plateau may be limited in comparison to the individual at the top of the plateau. Thus, a coordinator determining positions and orientations for the individuals may use data regarding their respective vertical fields of view as part of the determination, in addition to their respective horizontal fields of view.

Figure 6:
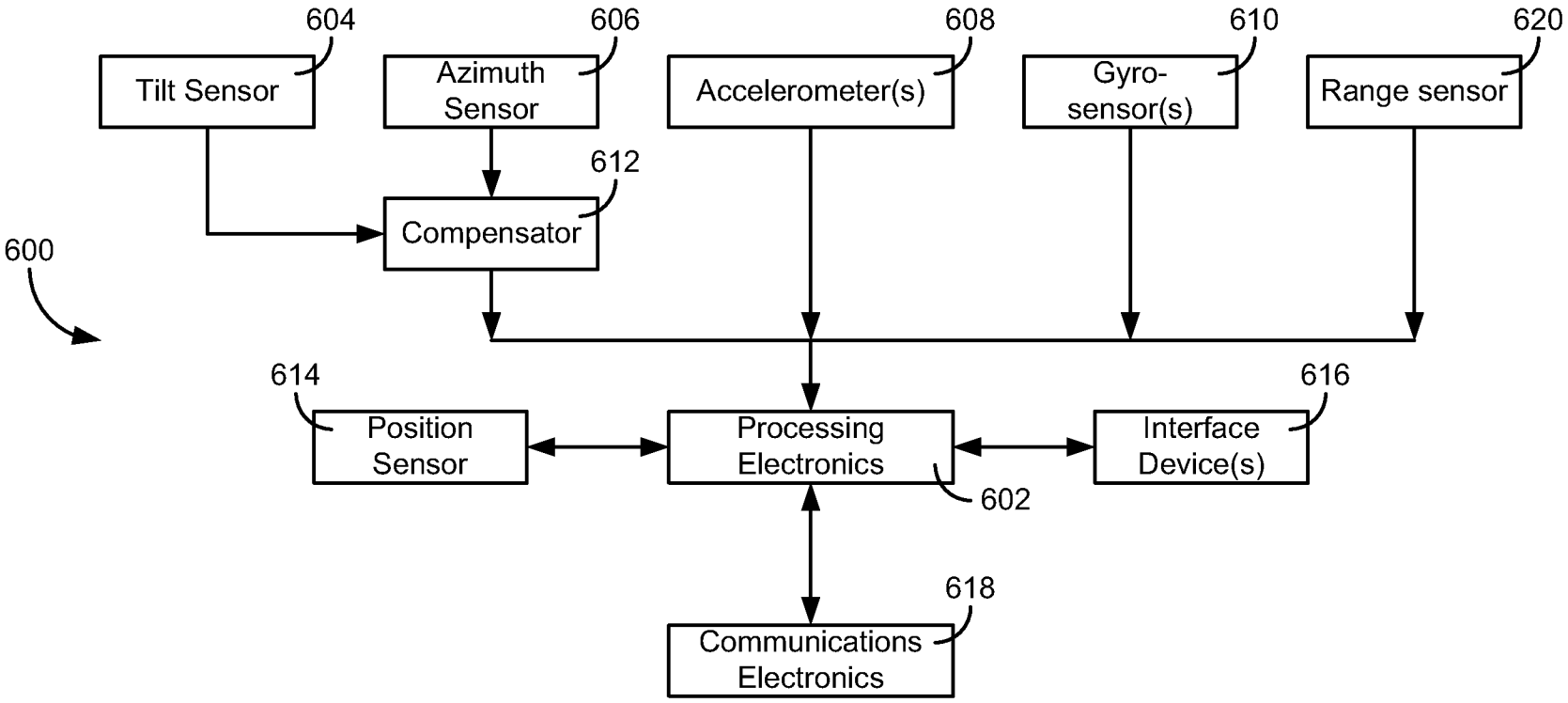
FIG. 6 is a schematic block diagram of a computerized system for analyzing an individual's field of view, according to an exemplary embodiment.

Referring now to FIG. 6, a schematic block diagram of a computerized system 600 for analyzing an individual's field of view is shown, according to various embodiments. System 600 may be part of a single device (i.e., the components of system 600 may reside within the same housing) or may be part of a distributed computing system. For example, system 600 may be part of a hand-held device or may be integrated into the equipment carried by an individual (e.g., integrated into a weapon carried by an individual). System 600 may include its own power source or may be configured to use a power source shared with other devices, in various embodiments.

System 600 may include one or more sensors configured to generate sensor data regarding an individual's field of view. For example, system 600 may include a tilt sensor 604, an azimuth sensor 606, one or more accelerometers 608, one or more gyro-sensors 610, a range sensor 620, and/or a position sensor 614. System 600 may also include processing electronics 602 configured to receive and process sensor data from sensors 602-610 and 614. The sensor data may be generated continuously and sampled by processing electronics 602. Processing electronics 602 may sample sensor data generated by sensors 602-610 and 614 in response to a manual command (e.g., in response to receiving a request from a user to take a field of view measurement) and/or automatically (e.g., in response to detecting motion via accelerometer 608). In one embodiment, sensor data may be collected at a frequency greater than or equal to one Hertz, allowing field of view data to be rapidly refreshed. In some cases, processing electronics 602 may issue a command to one of sensors 602-610 or 614 to activate the sensor. Sensors 602-610, 614, and 620 may be any form of sensors configured to measure movement, location, range, and/or orientation. In some cases, sensors 602-610, 614, and 620 may include optical, mechanical, electro-mechanical, or other forms of sensors.

Position sensor 614 may be any form of electronics configured to determine a geographical location. In one embodiment, position sensor 614 may utilize a satellite-based positioning system to generate location data. For example, the position sensor may be a GPS receiver, GLONASS receiver, etc. In other cases, the position sensor may use a ground-based positioning system to determine the location. For example, position sensor 614 may use radio triangulation to generate the location data.

Tilt sensor 604 may be configured to determine an estimation of elevation relative to a horizontal direction. Tilt sensor 604 may include, for example, a conductive body (e.g., a conductive ball, mercury, etc.) within a housing. When tilt sensor 604 is brought from a horizontal position to an inclined position, the conductivity in tilt sensor 604 may change. Typical tilt sensors have an operational range of +/−80% from horizontal, but tilt sensors with higher operational ranges may also be used in system 600. In some embodiments, tilt sensor 604 may be mounted to a weapon or other piece of aimed equipment, to measure the vertical direction in which the equipment is being aimed.

Azimuth sensor 606 may be configured to determine an azimuth relative to a reference direction. For example, azimuth sensor 606 may include a magnetic compass that determines the direction of magnetic north. Azimuth sensor 606 may generate sensor data indicative of the difference between the direction faced by azimuth sensor 606 and the reference direction. Similar to tilt sensor 604, azimuth sensor 606 may also be mounted to a weapon or aimed piece of equipment. In some embodiments, sensor data generated by azimuth sensor 606 and/or tilt sensor 604 may be used by processing electronics 602 to determine the bounds for a field of view or field of fire. For example, processing electronics 602 may automatically detect the widest swing in azimuth and/or elevation performed by an individual moving a weapon within a box (e.g., between left and right and between up and down).

System 600 may include one or more compensators 612, which may be implemented as hardware components and/or software executed by processing electronics 602. In general, compensators 612 operate to correct certain measurement variations in tilt sensor 604 and/or azimuth sensor 606. For example, the magnetic compass of azimuth sensor 606 may cause a slight bias in azimuth sensor 606 that may be compensated by compensators 612. Similarly, compensators 612 may correct for overshoot in tilt measurements from tilt sensor 604, which may be more pronounced in low-cost tilt sensors.

Accelerometers 608 and/or gyro-sensors 610 may be configured to detect motion in one or more directions. For example, accelerometers 608 may be configured to detect motion in a horizontal and/or vertical direction and gyro-sensors 610 may be configured to detect rotational motion. In some embodiments, motion data generated by accelerometers 608 and/or gyro-sensors 610 may be used by processing electronics 602 to begin determining a field of view. For example, accelerometers 608 and/or gyro-sensors 610 may detect when a weapon is being swung from being pointed in a first direction to being pointed in a second direction.

Range sensor 620 may be configured to determine the range to a particular target. In various implementations, range sensor 620 may include a laser or radar transmitter which transmits a laser or radar pulse towards a target. Range sensor 620 may also include a receiver configured to receive the laser or radar pulse that is reflected from the target. The amount of time taken between transmission of the pulse and receipt of the reflected pulse may then be used by range sensor 620 to determine the distance to the target. In some implementations, range sensor 620 may be configured for attachment to a weapon or other form of aimed piece of equipment. Thus, range sensor 620 may determine the range to a target, when the weapon or other form of equipment is aimed at the target. The determined range may then be used, for example, as another boundary for a field of view or field of fire (e.g., the maximum distance that can be seen or reached in a particular direction). In some implementations, range sensor 620 may be used to determine the range to obstacles, landmarks, or similar distinguishing features of the terrain within a field of view of field of fire.

System 600 may include communications electronics 618 configured to receive and/or transmit data to other electronic devices. Communications electronics 618 may include, for example, a radio transceiver and an antenna. In some embodiments, processing electronics 602 may be configured to transmit sensor data from sensors 604-610 and 614 to another device for analysis. In other words, processing electronics 602 may be configured to relay sensor data regarding a field of view to another electronic device. The other device in communication with processing electronics 602 may then use the sensor data to estimate a field of view, determine whether a hazardous condition exists, generate a collective field of view by aggregating two or more fields of view, and/or automatically determine positions and orientations for individuals, to optimize the collective field of view. In further embodiments, processing electronics 602 may be configured to perform some or all of these functions, itself.

System 600 may include one or more user interface devices 616. In general, a user interface device refers to any electronic device configured to generate and/or receive sensory data from a user. Interface devices 616 may include an electronic display, a speaker, a keypad, a pointing device, a heads-up display (HUD), a microphone, a switch, a button, or other forms of interface devices. In some embodiments, processing electronics 602 may be configured to record measurements regarding a field of view in response to receiving a request from interface devices 616. For example, an individual may operate one of interface devices 616 (e.g., by hitting a button, a switch, etc.) to signify that a new field of view or field of fire measurement is to be taken. The individual may then sweep a weapon in the horizontal and/or vertical directions, to record the corresponding field of view or field of fire data. In some embodiments, processing electronics 602 may be configured to provide an alert to an individual via interface devices 616. For example, processing electronics 602 may cause a speaker to produce a sound or a HUD to display a warning, if a hazardous condition is detected. In further embodiments, interface devices 616 may be configured to relay data received via communications electronics 618 to the user of system 600. For example, a human coordinator may radio an adjusted position or orientation to the user of system 600. In another example, a display in interface devices 616 may receive an indication of an adjusted position or orientation from processing electronics 602.

Figure 7:
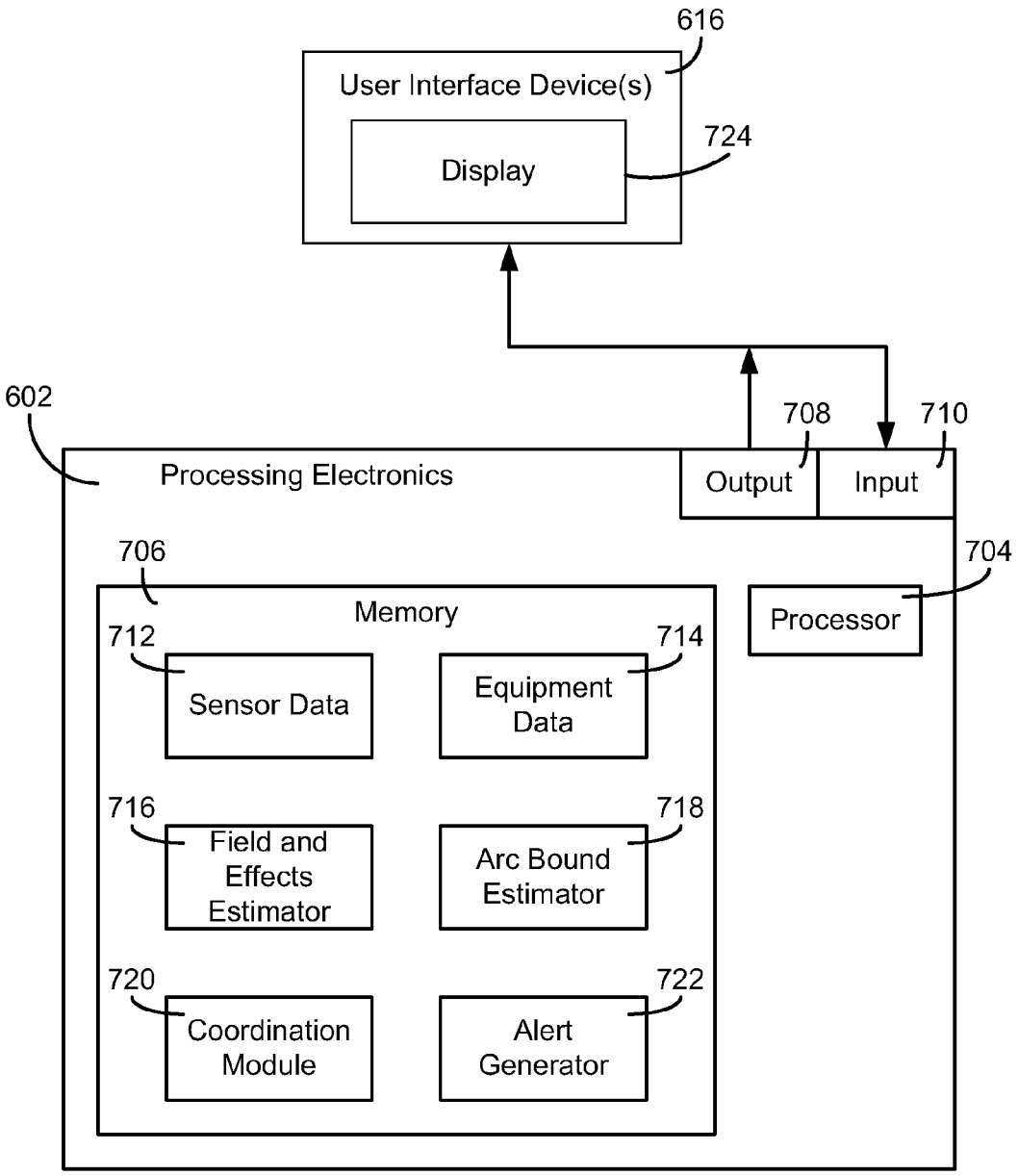
FIG. 7 is a block diagram of the processing electronics shown in FIG. 6, according to an exemplary embodiment.

Referring now to FIG. 7, a detailed block diagram of processing electronics 602 of FIG. 6 is shown, according to an exemplary embodiment. Processing electronics 602 includes a memory 706 and processor 704. Processor 704 may be or include one or more microprocessors, an application specific integrated circuit (ASIC), a circuit containing one or more processing components, a group of distributed processing components, circuitry for supporting a microprocessor, or other hardware configured for processing. According to an exemplary embodiment, processor 704 is configured to execute computer code stored in memory 706 to complete and facilitate the activities described herein. Memory 706 can be any volatile or non-volatile computer-readable storage medium capable of storing data or computer code relating to the activities described herein. For example, memory 706 is shown to include modules 716-722 which are computer code modules (e.g., executable code, object code, source code, script code, machine code, etc.) configured for execution by processor 704. When executed by processor 704, processing electronics 602 is configured to complete the activities described herein. Processing electronics includes hardware circuitry for supporting the execution of the computer code of modules 716-722. For example, processing electronics 602 includes hardware interfaces (e.g., output 708) for communicating data to interface devices 616 and/or communications electronics 618. Processing electronics 602 may also include an input 710 for receiving, for example, sensor data from sensors 604-610 and 614, data received via communications electronics 618, and data from interface devices 616.

Memory 706 includes sensor data 712 received from sensors 604-610, 614 and 620. Sensor data 712 may include measurements regarding one or more fields of view. For example, sensor data 712 may include data regarding the most current field of view measurements and/or a history of previous measurements. In some embodiments, sensor data 712 may include data regarding a three-dimensional field of view (e.g., sensor measurements taken along two or more planes of movement). For example, sensor data 712 may include data regarding measurements taken along a substantially horizontal direction and measurements taken along a substantially vertical direction. In some embodiments, sensor data 712 may be stored in response to receiving a request from one of interface devices 616 (e.g., a button, a switch, etc.) and/or from a motion detected by sensors 608, 610.

In some embodiments, memory 706 may include equipment data 714. In cases in which sensor data 712 includes measurements regarding a field of fire, equipment data 714 may include data regarding the corresponding weapon or other aimed device. Data regarding a weapon or aimed device may include a projectile range, a caliber of ammunition, ballistics data for a projectile, or similar data. For example, sensors 604-610 and/or sensor 614 may be integrated with a firearm and used to record measurements regarding its field of fire. Equipment data 714 may include data regarding the effective ranges for the firearm, to generate a field of fire for the firearm.

Memory 706 may include an arc bound estimator 718 configured to analyze sensor data 716 and/or equipment data 714 to construct a two or three-dimensional field of view. For example, arc bound estimator 718 may analyze sensor data 712 and/or equipment data 718, to determine one or more boundaries for a field of view or field of fire. In some embodiments, arc bound estimator 718 may determine the boundaries using the maximum azimuths in sensor data 712. For example, a rifle having attached azimuth sensors 606 may be swept left and right, to define the field of fire in a first plane of movement. The maximum azimuths stored in sensor data 712 may then be used by arc bound estimator 718 to define the boundaries of the field of fire in the first plane. In some embodiments, arc bound estimator 718 may use range data from equipment data 714 to determine the range for the field of fire.

Arc bound estimator 718 may provide display data representative of a field of view or field of fire to an electronic display 724. For example, arc bound estimator 718 may generate an electronic depiction of a two-dimensional range card or a three-dimensional depiction of the field of view. In some implementations, the depiction may include additional data regarding the field of view, such as a corresponding terrain map, obstacles identified by a user via an interface device, or similar data. Processing electronics 602 may provide the display data to display 724 or to a display of a remote device via communications electronics 618. For example, a depiction of an individual's field of fire may be transmitted to a display operated by a commanding officer, to monitor the individual's position and orientation.

In some embodiments, memory 706 may include field and effects estimator 716 configured to estimate potential outcomes regarding a field of fire. Field and effects estimator 716 may receive field of fire data generated by arc bound estimator 718 and predict certain outcomes within the field of fire. For example, field and effects estimator 716 may use equipment data 714 to determine a speed of fire for a weapon, a ballistic penetration of a bullet, and similar data for a weapon. Field and effects estimator 716 may compare obstacles and other known data regarding the area within the field of fire to predict potential outcomes. For example, a range for a field of fire through a greenhouse may be greater than through a concrete wall. Similar to arc bound estimator 718, field and effects estimator 716 may generate visual indicia and provide the indicia to an electronic display (e.g., as a layer on a displayed field of fire, etc.).

Processing electronics 602 may include a coordination module 720 configured to aggregate fields of view or fields of fire from a plurality of devices. For example, processing electronics 602 may receive field of fire data from another field device via communications electronics 618. In some embodiments, the received data may be an estimated field of fire (e.g., the remote field device also includes an arc bound estimator and/or a field and effects estimator). In other embodiments, raw sensor data may be received via communications electronics 618 and used by processing electronics 602 to estimate a field of fire and/or potential effects within the field of fire.

Coordination module 720 may be configured to generate display data representative of the aggregated fields of view or fields of fire. For example, the display may show the overlap and/or gaps between the fields. Any number of different angles or perspectives may be generated by coordination module 720 (e.g., a first screen that displays the aggregated horizontal portions of the fields of fire and a second screen that displays the aggregate vertical portions). In some implementations, coordination module 720 may also generate display data that shows an estimation of the collective field of view. A coordinator reviewing the display data from coordination module 720 may then analyze the positions and orientations of the deployed individuals to determine adjustments that optimize the collective field of view.

In some embodiments, coordination module 720 may be configured to automatically determine adjustments to an individual's position and/or orientation. For example, coordination module 720 may receive one or more goal parameters via input 710 indicative of a particular objective for individuals deployed to an area (e.g., to provide offensive or defensive cover over an area, to concentrate a search within a certain area, etc.). The automatically determined adjustments may be provided to a display for review by a coordinator or broadcast to other field devices, in various embodiments. For example, a coordinator may review adjustments suggested by coordination module 720 and choose whether to relay the adjustments to a deployed individual.

Memory 706 may include an alert generator 722 configured to determine whether a hazardous condition exists. In one embodiment, alert generator 722 may receive aggregated field of fire data from coordination module 720 and determine whether an individual is located within another individual's field of fire. For example, assume that one individual sweeps his rifle across the position of another deployed individual. In such a case, alert generator 722 may determine that a hazardous condition exists and provide an alert to a user interface device. For example, processing electronics 602 may provide an alert to a local speaker or display of a field device operated by the individual with the rifle. In some cases, processing circuit 602 may also provide an alert to the individual within the field of fire.

While arc bound estimator 718, field and effects estimator 716, coordination module 720, and alert generator 722 are depicted as being stored within memory 706, any combination of processing electronics are also contemplated. For example, coordination module 720 may be stored and executed by a remote coordination device. In such a case, processing circuit may transmit sensor data 712 and/or field of view data from arc bound estimator 718 to the remote device for analysis. In another example, alert generator 722 may reside within a separate device devoted to detecting hazardous conditions and generating alerts.

Figure 8:
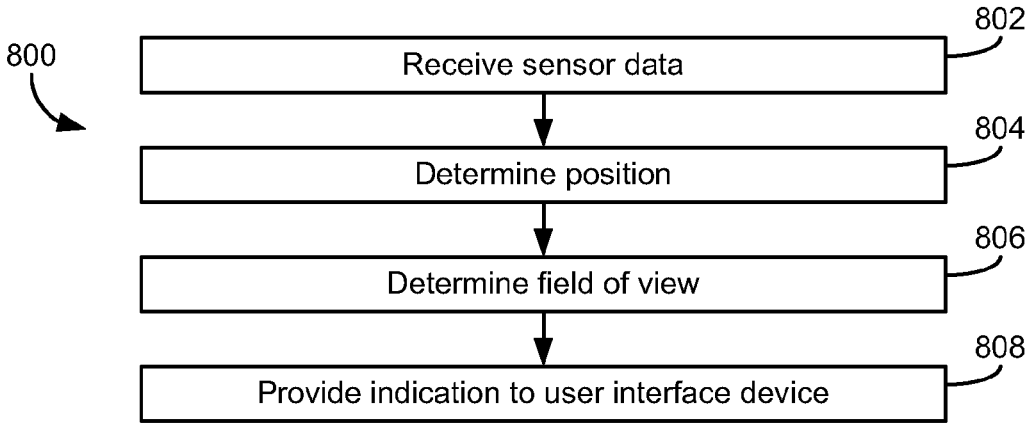
FIG. 8 is a flow chart of a process for determining a deployed individual's field of view, according to an exemplary embodiment.

Referring now to FIG. 8, a flow chart of a process 800 for determining an individual's field of view is shown, according to an exemplary embodiment. In various examples, the deployed individual may be a soldier, a first responder (e.g., a firefighter, a police officer, an emergency medical technician, etc.), a rescue worker, or any other type of individual that may be deployed to an area. In other embodiments, process 800 may be used to determine a non-human's field of view. For example, the field of view of a drone or vehicle may also be determined. In various embodiments, the field of view may be a field of fire for an aimed device, such as a weapon, a firefighting device, a camera, other forms of aimed devices, or combinations thereof.

Process 802 includes receiving sensor data (block 802). The sensor data may be any form of data regarding an orientation associated with the deployed individual. In various embodiments, the data regarding the orientation may be for the deployed individual or for an aimed piece of equipment used by the individual (e.g., a camera, a rifle, etc.). The sensor data may include one or more angle measurements relative to a reference direction, such as magnetic north (i.e., the sensor data may include azimuth measurements). For example, measurements may be taken to define one or more boundaries for an individual's two-dimensional field of view or field of fire. In some embodiments, measurements may be taken in multiple planes, to provide different dimensional components of the individual's three-dimensional field of view or field of fire. For example, a first set of azimuth measurements may be taken in a substantially horizontal direction and a second set of angle measurements may be taken in a substantially vertical direction. In one embodiment, the sensor data may also include one or more measured ranges within the field of view or field of fire.

Process 800 includes determining the position of the individual (block 804). The position of the individual may correspond to the individual's geographic location where the sensor data was captured. In some embodiments, the position of the individual may be determined using a satellite-based, navigation system, such as GPS. In other embodiments, ground-based triangulation may be used to determine the individual's position.

Process 800 includes determining a field of view using the received sensor data and position of the individual (block 806). In some embodiments, the field of view may correspond to the perspective of the individual when facing a particular direction from the location. For example, the sensor data may be associated with the individual's position, thereby forming a two-dimensional field of view (e.g., the horizontal or vertical view of the area from the perspective of the individual) and/or a three-dimensional field of view (e.g., by combining horizontal and vertical measurements). The field of view may include one or more ranges denoting the distance from the individual's position that can be seen by the individual in a particular direction. In some embodiments, the field of view may be a field of fire. If so, range data may be associated with the field of fire based on the capabilities of an aimed piece of equipment or weapon or specified manually by the individual. The field of view may also include obstacle data regarding one or more obstacles in the field of view. The obstacle data may be specified manually by the deployed individual or may be determined automatically using stored data regarding the terrain. For example, the location of certain landmarks within the field of view may be retrieved from a terrain database.

Process 800 includes providing an indication of the field of view to a user interface device (block 808). In some implementations, the indication may correspond to one or more depictions of the field of view on an electronic display. For example, one depiction of the field of view may correspond to the deployed individual's field of view within a first plane (e.g., a horizontal view) and a second depiction of the field of view may correspond to the field of view within a second plane (e.g., a vertical view). In some embodiments, a three-dimensional representation of the field of view may be provided to the display. For example, the representation may include elevation data, azimuth data, range data, and location data. In one embodiment, the indication of the field of view may correspond to an electronic representation of a range card, such as range card 200 shown in FIG. 2.

Figure 9:
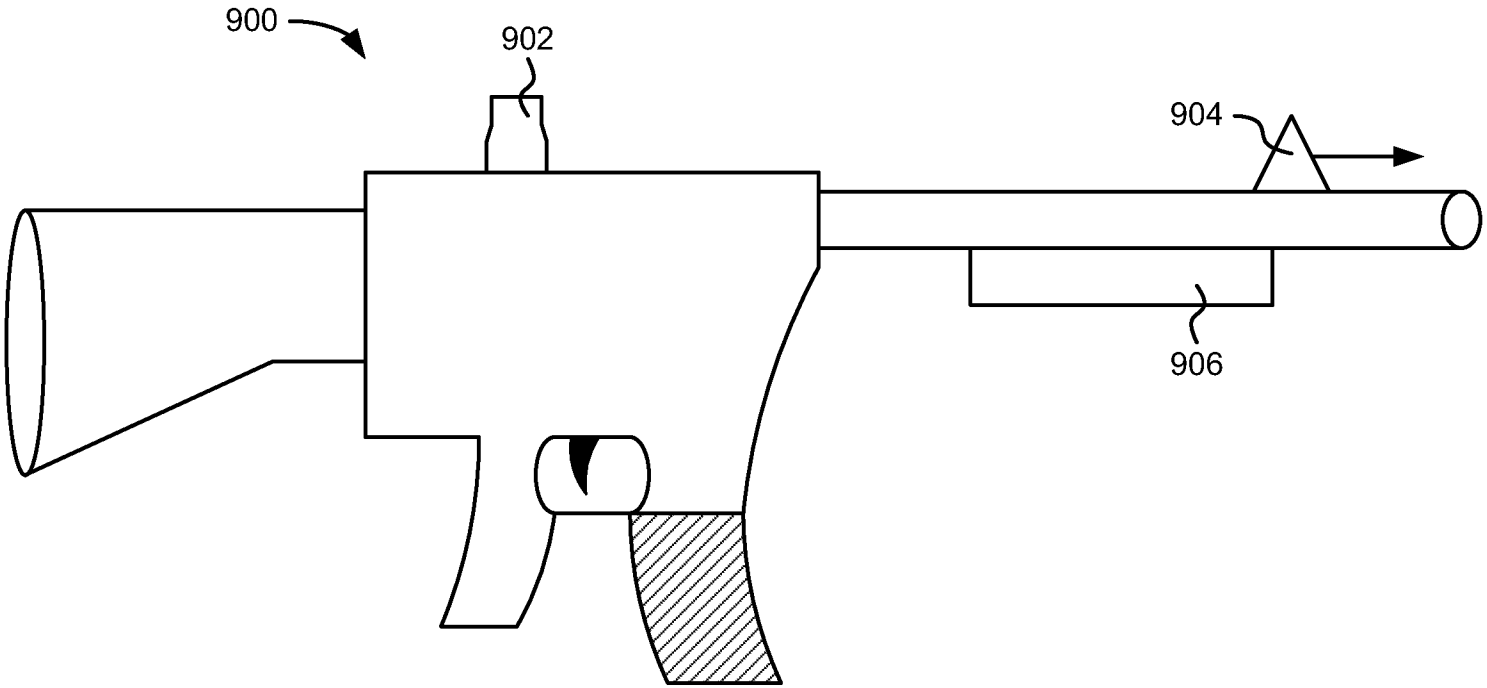
FIG. 9 is an illustration of a firearm having attached electronics, according to an exemplary embodiment.

Referring now to FIG. 9, an illustration of a firearm 900 having attached electronics is shown, according to an exemplary embodiment. In various embodiments, sensors may be attached to firearm 900 via a Picantilly rail or integrated directly into firearm 900. The sensors attached to firearm 900 may be configured to measure data regarding a field of fire for firearm 900. For example, electronics 906 may include one or more azimuth sensors, tilt sensors, accelerometers, gyro-sensors, and/or a location sensor. Electronics 906 may also include one or more user interface devices, such as a button, switch, etc.

In one example of operation, the capturing of field of fire data may be performed by aiming firearm 900 (i.e., by aligning rear sight 902 and front sight 904 with a target). The deployed individual may operate a user interface device of electronics 906 to signify that field of fire data is to be captured, while firearm 900 is being aimed. The individual may then sweep firearm 900 from a first boundary for the field of fire to a second boundary (e.g., by aiming firearm 900 in a first direction and moving firearm 900 to aim in a second direction). For example, firearm 900 may be swept in a horizontal direction from a first target to a second target. A motion sensor in electronics 906 may detect the motion and azimuth measurements taken during the motion may be stored. The maximum stored azimuths may then be used as the boundaries for the field of fire within a first plane. In some embodiments, additional field of fire measurements may be captured along other planes. For example, the individual may then sweep firearm 900 along a vertical plane and electronics 906 may capture field of fire data along this direction, as well.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise a non-transitory medium, such as RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A method of determining a field of view, comprising:

receiving sensor data regarding a field of view, the sensor data comprising measurements indicative of one or more boundaries for the field of view;

determining a geographic location at which the sensor data was generated;

analyzing the sensor data and the geographic location to determine the field of view;

aggregating fields of view from two or more geographic locations into a collective field of view;

providing the collective field of view to an electronic display, the collective field of view is a collective field of fire for two or more weapons; and generating an alert based in part on whether a geographic location associated with a first field of fire is located within a second field of fire.

2. The method of claim 1, wherein the one or more boundaries for the field of view comprise azimuth measurements within a first plane.

3. The method of claim 2, wherein the one or more boundaries for the field of view comprise tilt measurements within a second plane.

4. The method of claim 1, wherein the geographic location is determined using a satellite-based positioning system.

5. The method of claim 1, wherein the one or more boundaries for the field of view comprise range measurements from a range sensor.

6. The method of claim 1, further comprising:

associating the sensor data with a weapon;

retrieving weapon data from a memory, the weapon data comprising range data and ballistics data for the weapon; and using the weapon data to determine the first field of fire or the second field of fire.

7. A method of determining a collective field of view using sensor data, the method comprising:

aggregating fields of view from two or more geographic locations into a collective field of view;

providing the collective field of view to an electronic display, wherein the collective field of view is a collective field of fire for two or more weapons; and generating an alert based in part on whether a geographic location associated with a first field of fire is located within a second field of fire.

8. The method of claim 7, wherein one or more boundaries for each field of view comprise azimuth measurements within a first plane.

9. The method of claim 8, wherein the one or more boundaries for each field of view comprise tilt measurements within a second plane.

10. The method of claim 9, wherein the geographic location is determined using a satellite-based positioning system.

11. The method of claim 10, wherein the one or more boundaries for each field of view comprise range measurements from a range sensor.

12. The method of claim 7, wherein the alert is provided to a mobile device at the geographic location.

13. The method of claim 7, wherein, the alert is provided to a mobile device associated with the second field of fire.

14. A method, comprising:

using sensor data to determine at least two fields of view;

aggregating the fields of view into a collective field of view;

providing the collective field of view to an electronic display, wherein the collective field of view is a collective field of fire for two or more weapons; and generating an alert based in part on whether a geographic location associated with a first field of fire is located within a second field of fire.

15. The method of claim 14, wherein one or more boundaries for each field of view comprise azimuth measurements within a first plane.

16. The method of claim 14, wherein one or more boundaries for each field of view comprise tilt measurements within a second plane.

17. The method of claim 14, wherein the geographic location is determined using a satellite-based positioning system.

18. The method of claim 14, wherein one or more boundaries for each field of view comprise range measurements from a range sensor.

19. The method of claim 14, wherein the alert is provided to a mobile device in the second field of fire.

20. The method of claim 14, wherein the alert is an audio alert.

* * * * *